US012397338B2

(12) United States Patent
Syuutou et al.

(10) Patent No.: US 12,397,338 B2
(45) Date of Patent: Aug. 26, 2025

(54) BLANKING MOLD, BLANKING AND STACKING APPARATUS, AND BLANKING METHOD

(71) Applicant: G-TEKT CORPORATION, Saitama (JP)

(72) Inventors: Takahiro Syuutou, Saitama (JP); Yoshitaka Nakashizu, Tochigi (JP)

(73) Assignee: G-TEKT CORPORATION, Saitama (JP)

( * ) Notice: Subject to any disclaimer, the term of this patent is extended or adjusted under 35 U.S.C. 154(b) by 0 days.

(21) Appl. No.: 18/271,710

(22) PCT Filed: Apr. 14, 2023

(86) PCT No.: PCT/JP2023/015118

§ 371 (c)(1),
(2) Date: Mar. 13, 2025

(87) PCT Pub. No.: WO2024/009582

PCT Pub. Date: Jan. 11, 2024

(65) Prior Publication Data

US 2025/0235919 A1 Jul. 24, 2025

(30) Foreign Application Priority Data

Jul. 7, 2022 (JP) ..... 2022-109583

(51) Int. Cl.
*B21D 28/14* (2006.01)
*B21D 43/22* (2006.01)

(52) U.S. Cl.
CPC ..... *B21D 28/14* (2013.01); *B21D 43/22* (2013.01)

(58) Field of Classification Search
CPC ..... B21D 28/14; B21D 43/00; B21D 43/22; B21D 45/00

(Continued)

(56) References Cited

U.S. PATENT DOCUMENTS 4,820,102 A * 4/1989 Messerly ..... B21D 43/22 414/788.9
4,901,842 A * 2/1990 Lemboke ..... B65G 47/2445 198/623

(Continued)

FOREIGN PATENT DOCUMENTS

JP S57-181431 11/1982
JP 59-133920 8/1984

(Continued)

OTHER PUBLICATIONS

Decision to Grant a Patent for Japanese Patent Application No. 2022-109583, issued Oct. 28, 2022.

(Continued)

*Primary Examiner* — Leslie A Nicholson, III
(74) *Attorney, Agent, or Firm* — Andrus Intellectual Property Law, LLP

(57) ABSTRACT

A die for a blanking device, a blanking accumulation device, and a blanking method are provided with which blanks having a length that is greater than a width of a metal coil can be blanked and accumulated in an accumulating device (piler), with a target orientation.

The method includes a continuous metal coil that is received and is subjected to blanking using a die. The die has a shearing portion for blanking a blank. The shearing portion has an inclination angle relative to a line direction in which the blank is discharged. The die further includes, downstream of the shearing portion, a discharge means including an orientation changing means for changing an orientation of the blank from an inclined state having a first inclination angle, at the time at which shearing is complete, to a second larger inclination angle.

13 Claims, 15 Drawing Sheets

(58) Field of Classification Search
USPC ..... 198/577, 623
See application file for complete search history.

(56) References Cited

U.S. PATENT DOCUMENTS

| | | | | |
|---|---|---|---|---|
| 5,039,084 | A * | 8/1991 | Messerly | B65H 31/20 414/790 |
| 5,221,177 | A * | 6/1993 | Messerly | B65H 29/68 414/788.9 |
| 2008/0044622 | A1 | 2/2008 | Noda et al. | |

FOREIGN PATENT DOCUMENTS

| | | |
|---|---|---|
| JP | 59-188356 | 10/1984 |
| JP | H3-251245 | 11/1991 |
| JP | H0656317 A | 3/1994 |
| JP | 11-077427 | 3/1999 |
| JP | H11-077427 | 3/1999 |
| JP | 2002-178428 | 6/2002 |
| JP | 3742804 | 2/2006 |
| JP | 2008-025083 | 2/2008 |
| JP | 2011-225000 | 11/2011 |
| JP | 2013-132535 | 7/2013 |
| JP | 2015-128573 | 7/2015 |
| JP | 2015-192862 | 11/2015 |
| JP | 174881 | 11/2022 |
| JP | 7174881 | 11/2022 |

OTHER PUBLICATIONS

Notice of Reasons for Refusal for corresponding Japanese Application No. 2022-109583, issued Aug. 19, 2022.

* cited by examiner

[FIG.1]
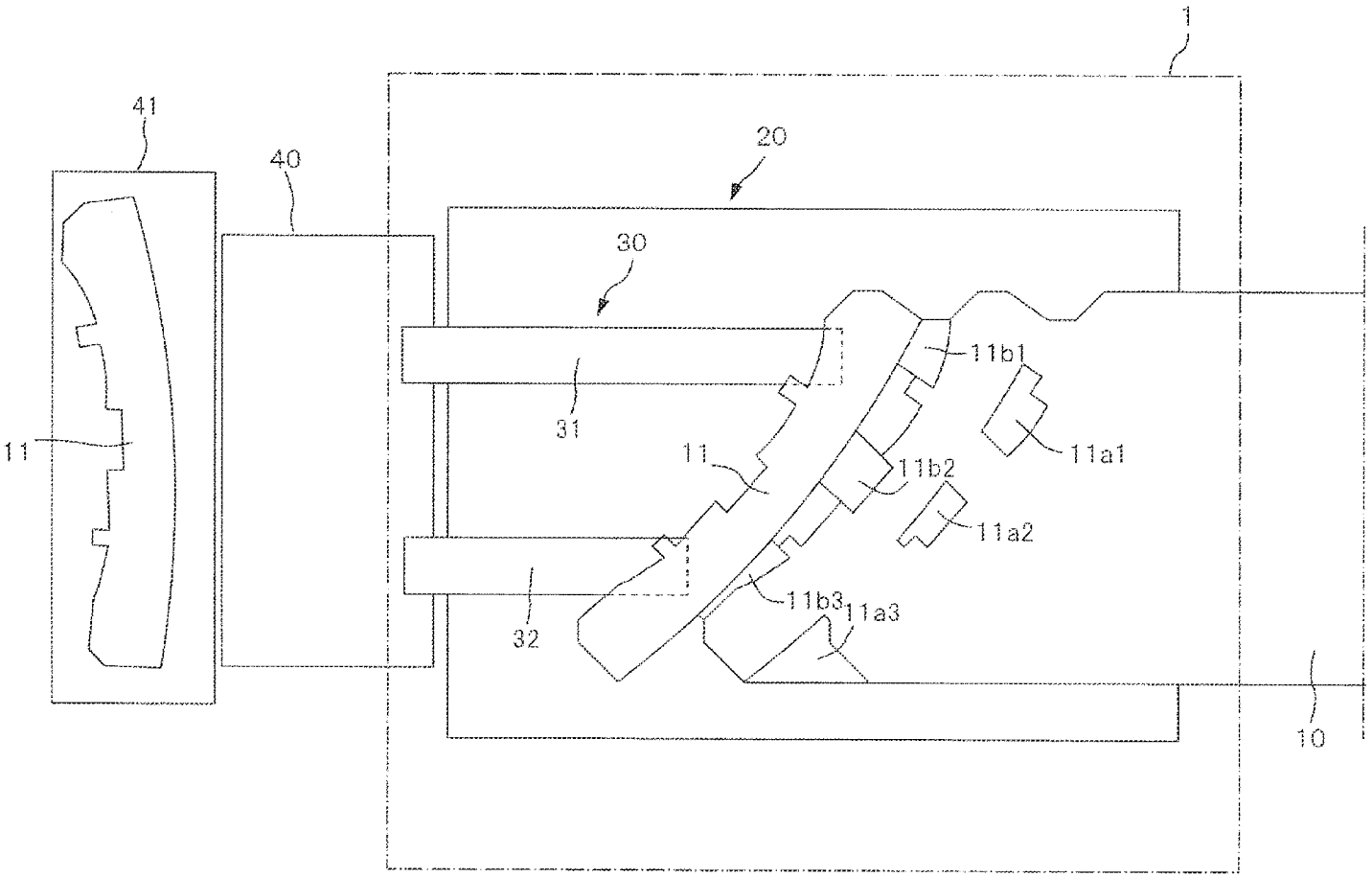

[FIG.2]
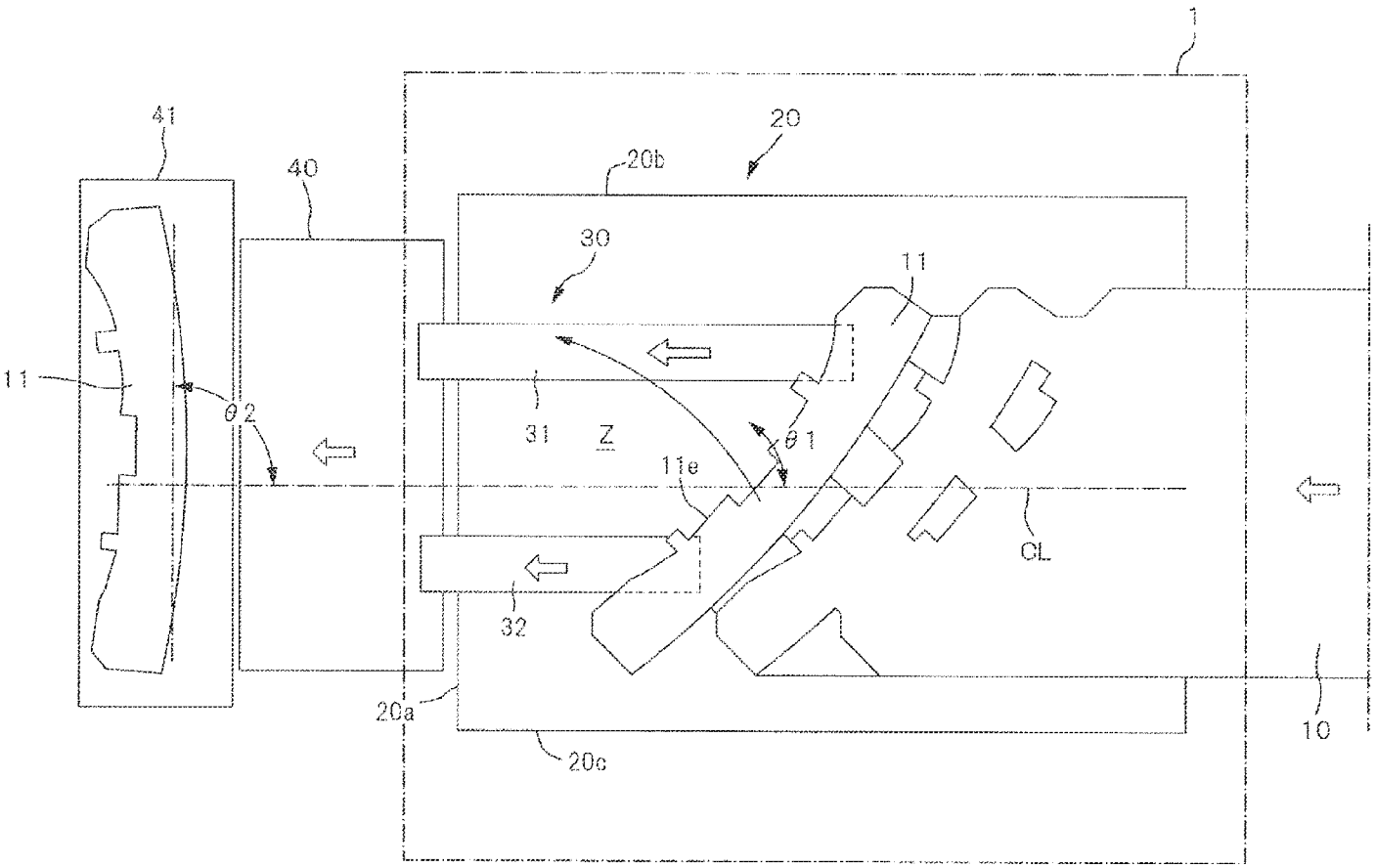

[FIG.2A]
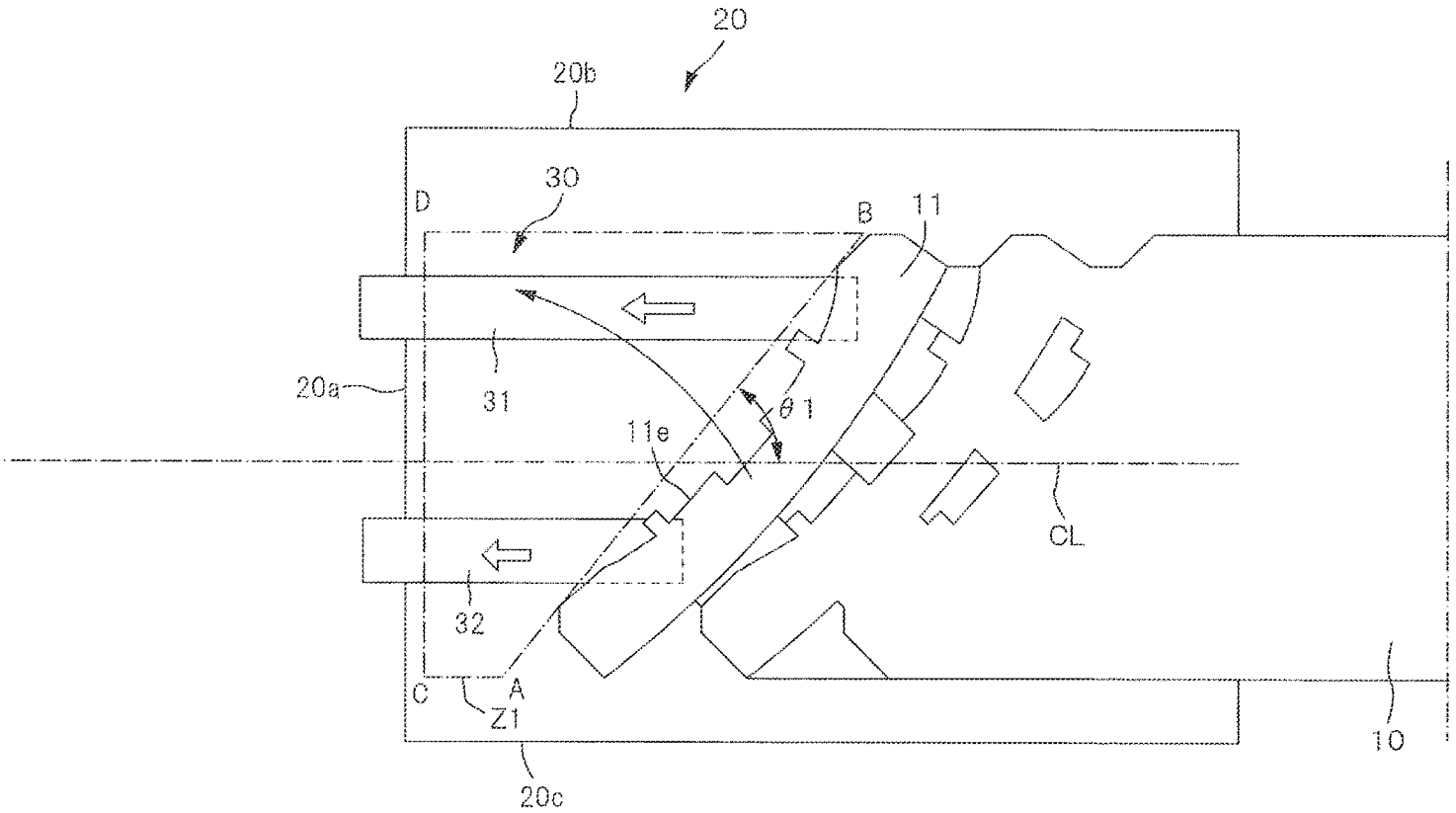

[FIG.2B]
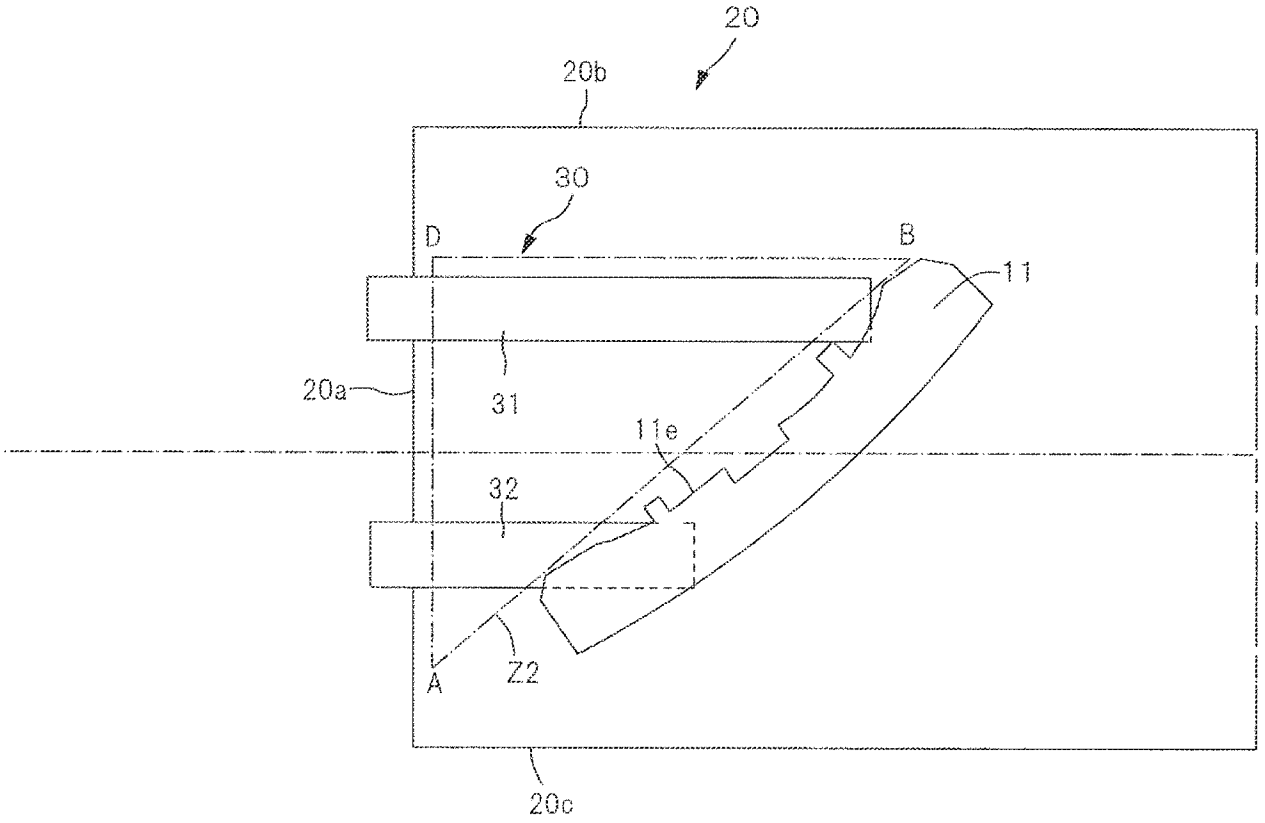

[FIG.3]
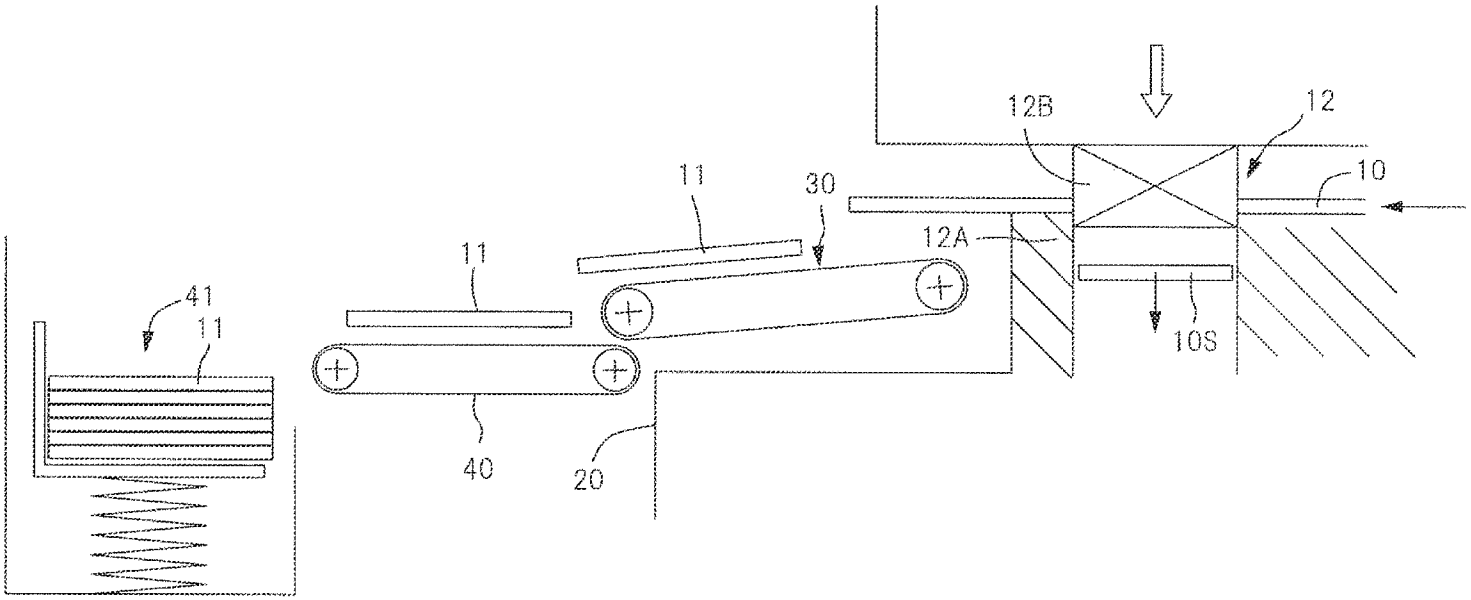

[FIG.4]
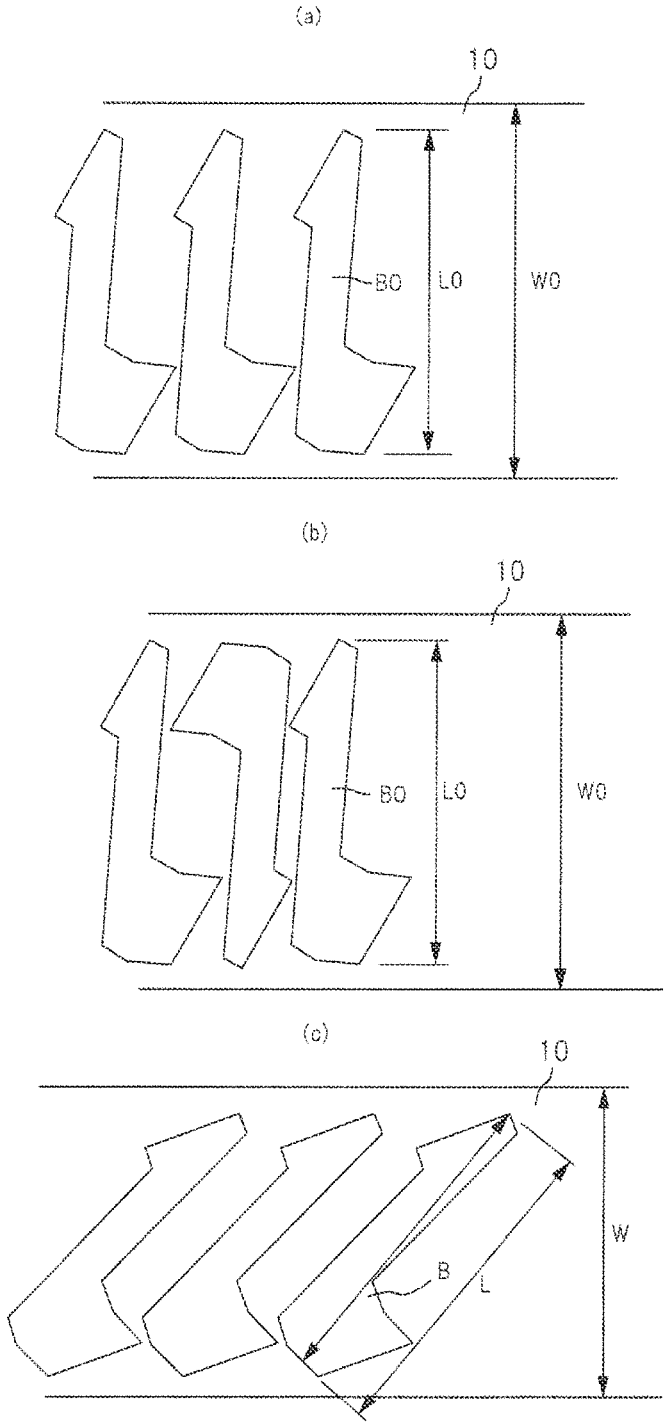

[FIG.5]
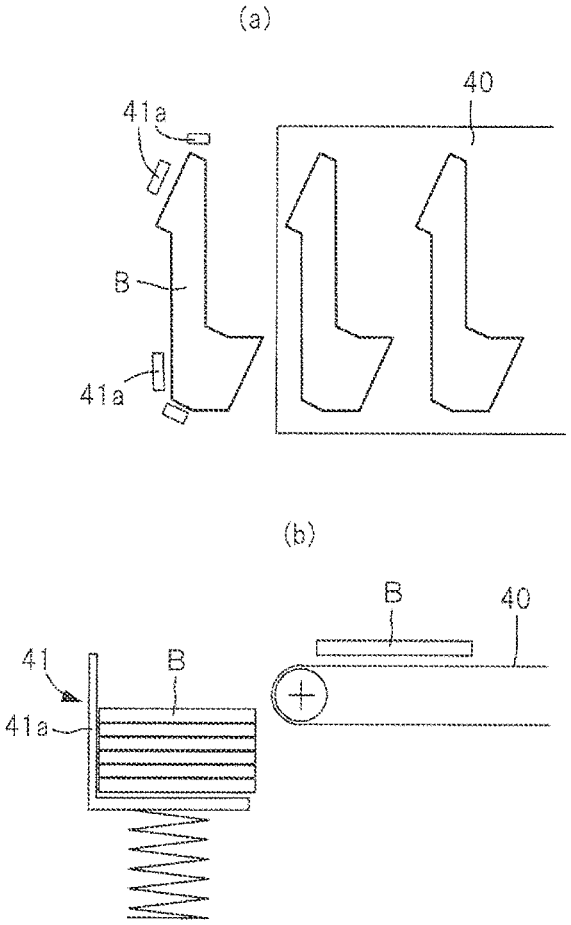

[FIG.6]
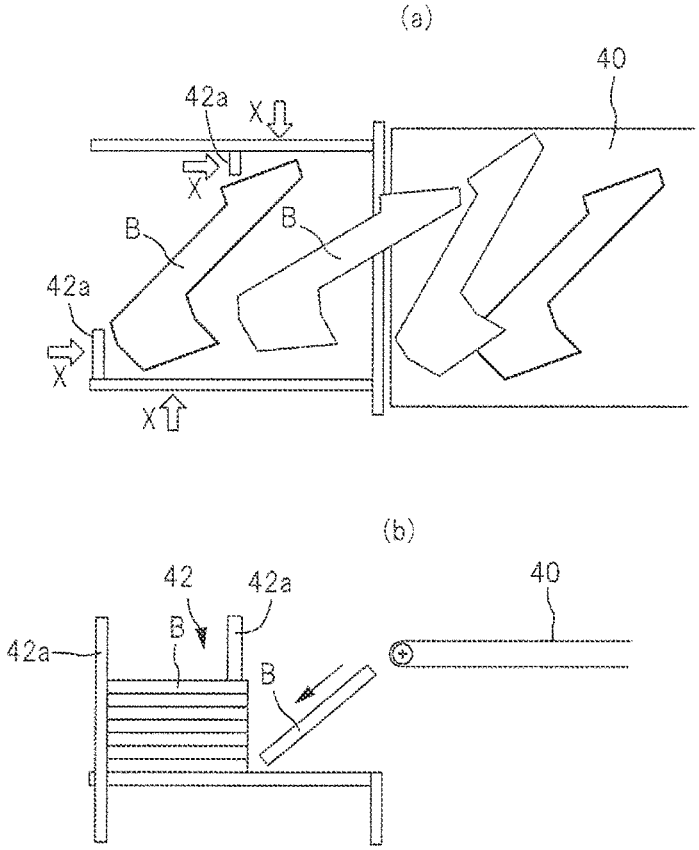

[FIG.7]
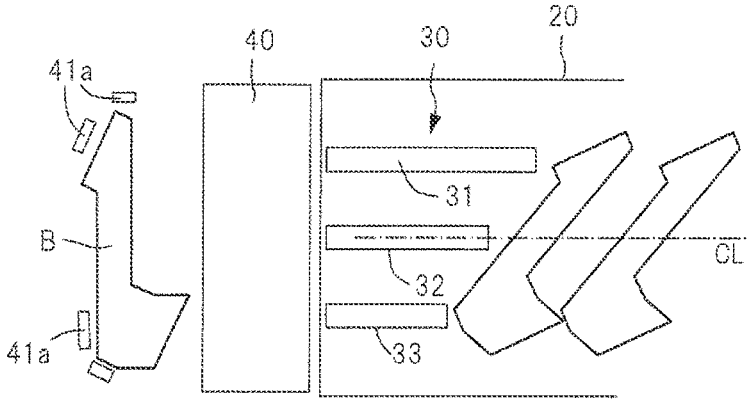

[FIG.8]
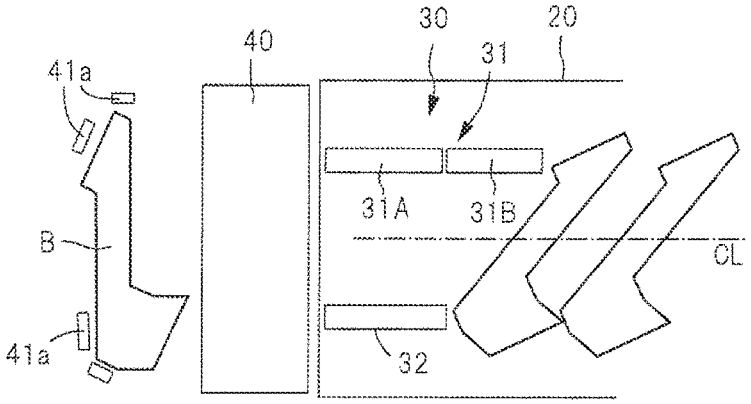

[FIG.9]
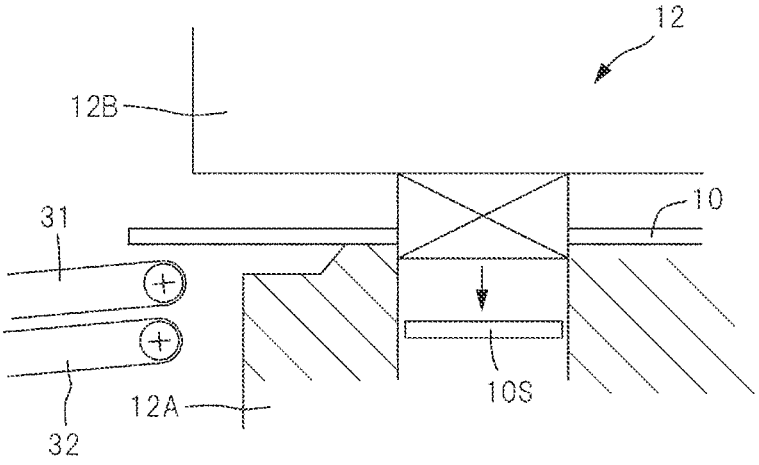

[FIG.10]
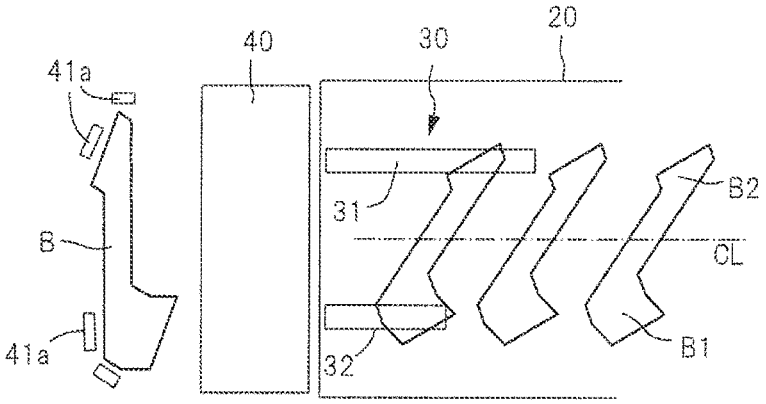

[FIG.11]
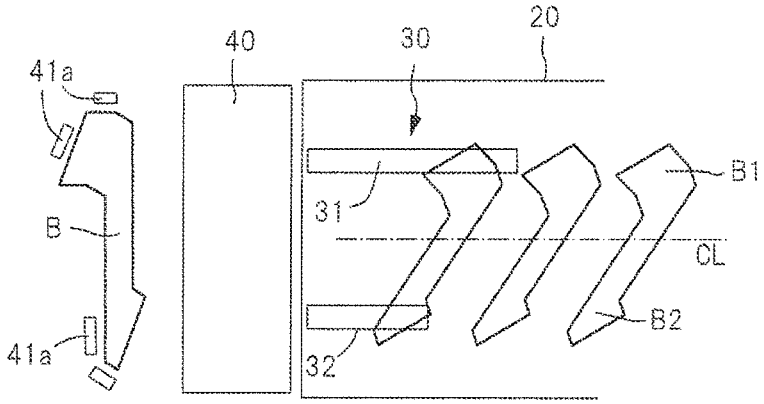

[FIG.12]
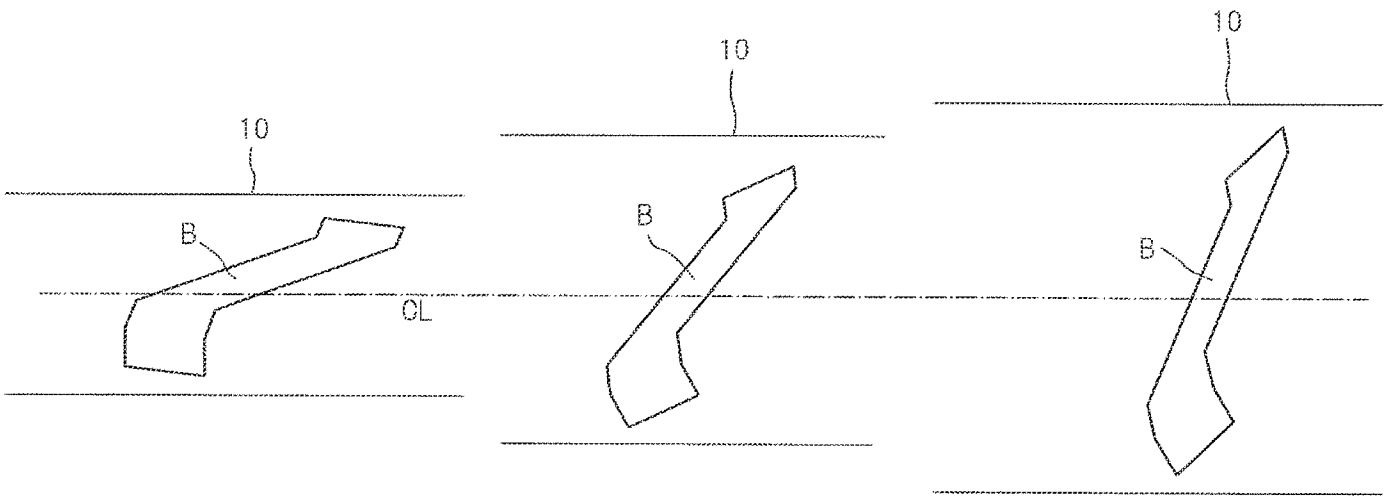

[FIG.13]
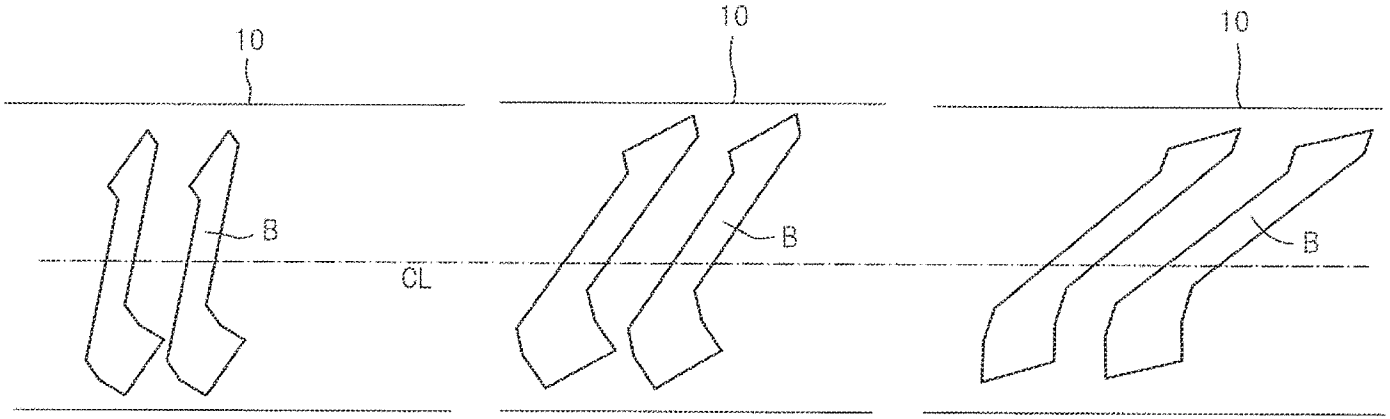

BLANKING MOLD, BLANKING AND STACKING APPARATUS, AND BLANKING METHOD

CROSS-REFERENCE TO RELATED APPLICATIONS

This application is the U.S. national stage application of International Application PCT/JP2023/015118, filed Apr. 14, 2023. The International Application claims priority of Japanese Patent Application No. 2022-109583, filed Jul. 7, 2022. The international application and Japanese application are both incorporated herein by reference, in entirety.

FIELD OF ART

The present invention relates to a blanking mold, a blanking and stacking apparatus, and a blanking method.

BACKGROUND ART

For the production of large-size molded products, such as front pillars, cross members, outer panels, and side door panels of vehicles, large size blanks are produced by a blanking apparatus at high speed, which are then fed to a press, for improved production efficiency.

There is known an apparatus for conveying blanks, including a plurality of chain conveyors provided between a carry-in position into and carry-out position out of a mold of a press, for conveying blanks fed from a blanking apparatus, and lifting means provided on both sides of the mold, for lifting up and down the chain conveyors between a position higher than the position of the lower mold and a retracted position lower than the position of the lower mold (Patent Publication 1).

This publication teaches to position a plate material for blanking onto a mold of a press by regulating the feed rates of the plurality of chain conveyors.

Patent Publication 1: JP 3742804 B2

SUMMARY OF THE INVENTION

Problems to be Solved by the Invention

Blanks obtained by blanking a metal coil in a blanking (press) apparatus are tentatively stacked in a piler before being fed to a subsequent press.

On the other hand, the workpieces produced by blanking conventionally had a dimension in the width direction of the metal coil the same as or smaller than the width of the metal coil.

It is therefore a primary object of the present invention to provide a blanking mold, a blanking and stacking apparatus, and a blanking method, which realize blanking to produce blanks having a dimension in the width direction of the metal coil larger than the width of the metal coil, and stacking of the blanks in an intended orientation in the piler.

Means for Solving the Problems

An aspect of the blanking apparatus which solves the above-mentioned problems is as follows.

A blanking apparatus configured to perform blanking of a feed of metal coil continuous in a line direction, and to unload and convey resulting blanks, including:

a mold including a shearing section for performing blanking of the feed of metal coil to produce blanks at an inclination angle with respect to the line direction in which the blanks are to be unloaded, and an unloader located downstream of the shearing section and having an orientation-adjuster for adjusting an orientation of the blanks from an inclined state at a first inclination angle with respect to the line direction to a larger, second inclination angle, wherein the unloader having the orientation-adjuster includes a first belt conveyor with a longer conveying distance and a second belt conveyor with a shorter conveying distance, which are arranged substantially in parallel and on which the blanks are conveyed, with a conveying rate of the first belt conveyor being faster than a conveying rate of the second belt conveyor.

Further, an aspect of the blanking and stacking apparatus is as follows.

A blanking and stacking apparatus configured to perform blanking of a feed of continuous metal coil, and to unload and convey resulting blanks comprising:

a mold including a shearing section for performing blanking of the feed of metal coil to produce blanks at an inclination angle with respect to a line direction in which the blanks are to be unloaded, an unloader located downstream of the shearing section and having an orientation-adjuster for adjusting an orientation of the blanks from an inclined state at a first inclination angle with respect to the line direction to a larger, second inclination angle, a conveyor for the blanks located on an exit side of the unloader, and a piler for stacking in succession the blanks conveyed out of the conveyor into a pile, wherein the orientation-adjuster includes a first belt conveyor with a longer conveying distance and a second belt conveyor with a shorter conveying distance, which are arranged substantially in parallel and on which the blanks are conveyed, with a conveying rate of the first belt conveyor being faster than a conveying rate of the second belt conveyor.

Further, an aspect of the first blanking method is as follows.

A blanking method comprising:

performing blanking of a feed of continuous metal coil in a blanking apparatus, and unloading and conveying resulting blanks, wherein the blanking apparatus includes a mold, and the mold includes:

a shearing section for performing blanking of the feed of metal coil to produce blanks at an inclination angle with respect to a line direction in which the blanks are to be unloaded, and an orientation-adjuster located downstream of the shearing section in the line direction, for adjusting an orientation of the blanks on a conveying surface from an inclined state at a first inclination angle with respect to the line direction to a larger, second inclination angle, and for guiding the blanks forward from the mold, wherein the orientation-adjuster includes a first belt conveyor with a longer conveying distance and a second belt conveyor with a shorter conveying distance, which are arranged substantially in parallel and on which the blanks are conveyed, with a conveying rate of the first belt conveyor being faster than a conveying rate of the second belt conveyor, and wherein the blanking is performed at an inclination angle selected from larger to smaller angles in proportion to a larger to smaller width of the metal coil to produce a predetermined length of the blanks.

As aspect of the second blanking method is as follows.

A blanking method including:

performing blanking of a feed of continuous metal coil in a blanking apparatus, and unloading and conveying resulting blanks, wherein the blanking apparatus includes a mold, and the mold includes:

a shearing section for performing blanking of the feed of metal coil to produce blanks at an inclination angle with respect to a line direction in which the blanks are to be unloaded, and an orientation-adjuster located downstream of the shearing section in the line direction for adjusting an orientation of the blanks on a conveying surface from an inclined state at a first inclination angle with respect to the line direction to a larger, second inclination angle, and for guiding the blanks forward from the mold, wherein the orientation-adjuster includes a first belt conveyor with a longer conveying distance and a second belt conveyor with a shorter conveying distance, which are arranged substantially in parallel and on which the blanks are conveyed, with a conveying rate of the first belt conveyor being faster than a conveying rate of the second belt conveyor, and wherein the blanking is performed at an inclination angle selected from smaller to larger angles in proportion to a larger to smaller length of the blanks, with respect to a predetermined width of the metal coil.

Effect of the Invention

According to the present invention, blanks having a dimension in the width direction of the metal coil larger than the width of the metal coil may be produced through blanking, and stacked in the piler in an intended orientation.

BRIEF DESCRIPTION OF THE DRAWINGS

FIG. 1 is a schematic plan view of an embodiment of the present invention.

FIG. 2 is a schematic plan view of the embodiment of the present invention for explaining the motion of the blanks.

FIG. 2A is an explanatory view of an installable area for the unloader having an orientation-adjuster.

FIG. 2B is an other explanatory view of an installable area for the unloader having an orientation-adjuster.

FIG. 3 is a schematic front view of the shearing section.

FIGS. 4(*a*) to 4(*c*) illustrate in plan views embodiments of the blanking in view of the width of the metal coil.

FIG. 5 illustrates conveying and stacking of the blanks, wherein FIG. 5(*a*) is a plan view and FIG. 5(*b*) is a schematic front view.

FIG. 6 illustrates conveying and stacking of the blanks without adjusting their orientations, wherein FIG. 6(*a*) is a plan view and FIG. 6(*b*) is a schematic front view.

FIG. 7 is a schematic plan view of an embodiment of the unloader having an orientation-adjuster.

FIG. 8 is a schematic plan view of an embodiment of the unloader having an alternative adjuster.

FIG. 9 is a schematic front view of an embodiment of the unloader having an orientation-adjuster.

FIG. 10 is a schematic plan view of an embodiment of the unloader having an alternative orientation-adjuster.

FIG. 11 is a schematic plan view of an embodiment of the unloader having a still alternative orientation-adjuster.

FIG. 12 is an explanatory view of a first embodiment wherein the blanking is performed at an inclination angle selected in proportion to the length of the blanks to be produced, with respect to the predetermined width of metal coil.

FIG. 13 is an explanatory view of a second embodiment wherein the blanking is performed at an inclination angle selected in proportion to the length of the blanks to be produced, with respect to the predetermined width of metal coil.

MODE FOR CARRYING OUT THE INVENTION

Embodiments of the present invention will now be discussed with reference to the attached drawings.

FIG. 1 shows a blanking apparatus 1, with its upper mold being omitted and only its lower mold 20 being shown in a plan view.

The blanking apparatus 1 is configured to perform blanking of a feed of continuous metal coil 10, and to unload and convey the blanks 11 from the mold 20.

Referring to FIG. 2, the mold 20 has a shearing section 12, wherein blanking the metal coil 10 to produce blanks 11 is performed at an inclination angle θ1 with respect to the line direction CL in which the blanks 11 are to be unloaded. The shearing section 12 includes, as shown in FIG. 3, a lower blade (blanking die) 12A of the lower mold and an upper blade (blanking punch) 12C of the upper mold. Referred to by the reference numeral 10S is scrap.

The mold 20 also has, downstream of the shearing section 12, unloader 30 having an orientation-adjuster for adjusting the orientation of the blanks 11 from an inclined state upon completion of the shearing at a first inclination angle θ1 with respect to the line direction CL to a larger, second inclination angle θ2 which allows stacking of the blanks 11 in alignment with each other in a generally rectangular piler 41 as shown in FIG. 2, preferably perpendicular to the line direction CL.

Here, angle θ2 minus angle θ1 may preferably be less than 90 degrees and 30 degrees or more.

Also provided is a conveyor 40 for the blanks 11 located on the exit side of the unloader 30, and a piler 41 for stacking in succession the blanks 11 conveyed out of the conveyor 40 into a pile.

The mold 10 according to the embodiment is a progressive mold, which has shearing sections 12 in line with the shearing steps along the feeding direction of the metal coil 10.

For example, in order to form an inclined, indented contour, a first step of punching is performed by shearing part of the indented contour to form punched areas 11*al* to 11*a*3, and subsequently a second step of contour machining is performed for forming contour-machined areas 11*b*1 to 11*b*3 to completely shear the contour to obtain individual blanks 11.

In forming blanks with a simple contour, the shearing process may be performed with one blade without employing a progressive mold.

FIGS. 1 and 2 have been discussed taking the blanks for a cross member as an example. Now referring to FIG. 4, layouts of blanks are discussed taking blanks for a front pillar as an example.

When the length L of the blanks B is shorter than the width W0 of the metal coil 10, the blanking may be performed successively, with the blanks being aligned to the width direction of the metal coil 10 as in the layout examples shown in FIGS. 4(*a*) and 4(*b*) for utilizing the overall metal coil 10 as much as possible to improve the yield.

On the other hand, in the case of blanks B which are longer than the width W of the metal coil 10 or which leave little bridges on both sides in the direction of the width W, the blanks B should be arranged in an inclined layout, for example, as shown in FIG. 4(*c*). Alternatively, it may be envisaged to use a wider metal coil 10 in proportion to the length L of the blanks B. However, in view of limited variation of width available for metal coils 10, it is desirable to layout the blanks B in an inclined fashion, for example, as shown in FIG. 4(*c*), for improving the yield.

Here, when the blanking is performed with an inclined layout of the blanks B, for example, as shown in FIG. 4(*c*), the blanks obtained from the blanking are unloaded from the mold, conveyed on a conveyor 40, such as a belt conveyor, and stacked in a piler 41. Meanwhile, on the conveyor 40, the blanks B are conveyed in the orientation in which they were first brought into contact with the top surface of the conveyor 40, such as a belt conveyor. Moreover, large-size blanks B are conveyed at an angle inclined with respect to the line direction, so that individual blanks B are conveyed to the piler without being aligned to each other in the conveying direction, and allowed to fall therein to be stacked into a pile.

The individual blanks B, when allowed to fall in the piler 41 to be stacked into a pile without being aligned to each other in the conveying direction, may not be (properly) stacked in an intended orientation in the piler. In addition, as the blanks are inclined, the piler needs to be larger in size.

Consequently, it is necessary to stack the blanks in an intended orientation successively in order. According to an embodiment of the invention, based on the idea of adjusting (correcting) the orientation of the blanks, orientation-adjusting and unloader 30 is disposed in the mold 20.

Here, it is conceivable to adjust (correct) the orientation of the blanks after the blanks are unloaded from the mold 20. In other words, it is conceivable to dispose the blank-orientation-adjuster (corrector) between the mold 20 and the piler 41.

However, disposing the blank-orientation-adjuster (corrector) between the mold 20 and the piler 41 would require drastic change of the system, and should thus be avoided. Further, the blanks that have gone through the final shearing step are loose, and their orientation may not become stable before being unloaded from the mold 20.

It is also probable that the blanks B may fall into the "installable area" and no longer be conveyed.

On the other hand, disposing the orientation-adjusting and unloader 30 within the mold 20 allows stable adjustment of the orientation as well as stable unloading and conveying, and does not require drastic change of the system, which leads to great economical advantage. In addition, in response to the alteration of the blanking products, the operation control of the orientation-adjusting and unloader 30 may simply be modified, or the mold may simply be replaced with a mold 20 equipped with the orientation-adjusting and unloader 30, which is highly desirable in view of production efficiency. Alternatively, an existing mold may be provided with the orientation-adjusting and unloader 30, utilizing an empty space, i.e., the "installable area" as will be discussed later. This is particularly advantageous for continuous production of inclined blanks in a compact space.

Next, the substance of the present invention will now be discussed with reference to some specific embodiments.

First Embodiment

FIGS. 1 to 3 show a first embodiment, whose structure is as discussed above. This first embodiment allows high-speed production by performing the blanking process, adjustment of orientation, and stacking, with the blanks being arranged in the inclined layout as in FIG. 4(*c*) for improved yield.

The mold 20 is an example of a progressive mold, and has a shearing section 12 in which the blanking is performed to produce the blanks 11 at an inclination angle of θ1 with respect to the line direction CL, in which a metal coil 10 is fed from an uncoiler and the blanks 11 are to be unloaded. The details of the upper mold is not shown, and a commonly-known structure may be employed.

The mold 20 has, downstream of the shearing section 12, unloader 30 having an orientation-adjuster for adjusting the orientation of blanks 11 from an inclined state upon completion of the shearing at a first inclination angle θ1 with respect to the line direction CL to a larger, second inclination angle θ2 which allows stacking of the blanks 11 in alignment with each other in rectangular piler 41 as shown in FIG. 2, preferably perpendicular to the line direction CL.

In the first embodiment, the unloader 30 having the orientation-adjuster has a first belt conveyor 31 with a longer conveying distance and a second belt conveyor 32 with a shorter conveying distance, which are arranged substantially in parallel and on which the blanks 11 are conveyed, with the conveying rate of the first belt conveyor 31 being faster than the conveying rate of the second belt conveyor 32.

Here, the conveying rate of the first belt conveyor 31 in the line direction and the conveying rate of the second belt conveyor 32 in the line direction are the same as or higher than the conveying rate of the metal coil in the line direction, so that the blanks may be unloaded without accumulating.

The unloader 30 having the orientation-adjuster of the first embodiment has both the functions to adjust the orientation of and to unload and convey the blanks.

That is, during the transfer by means of the first belt conveyor 31 with a longer conveying distance and the second belt conveyor 32 with a shorter conveying distance, with the conveying rate of the first belt conveyor 31 being faster than the conveying rate of the second belt conveyor 32, the respective blanks 11 may be rotated counterclockwise as seen in FIG. 2, while the blanks 11 are unloaded from the mold 20 into the rectangular piler 41 in alignment with each other.

The unloader 30 having the orientation-adjuster may have the orientation-adjuster and the unloader separately composed. The orientation-adjuster may be composed of a turn table, while the unloader may be composed of the belt conveyor or a chute.

The blanks 11 unloaded from the mold 20 are conveyed by means of the conveyor 40 for blanks 11, such as a belt conveyor or a chute, located at the exit side of the unloader 30, and successively stacked into a pile in the piler 41.

As shown in FIGS. 2 and 3, by positioning the entry side of the blank-conveyor 40 below and underlapping the exit side of the unloader 30, the blanks 11 whose orientations have been adjusted may be allowed to fall onto the conveyor 40 for high-speed unloading and conveying.

The piler 41 is provided, for example as in the embodiment shown in FIG. 5, with plate-like positioning stampers 41*a*, of which cylinders are driven to lift up and down the stampers 41*a*, at each longitudinal end of the blanks B of which orientations have been adjusted. The stampers 41*a* are disposed on the surfaces along the thickness direction of the blanks B, two facing each other at each longitudinal end and positioning the blanks B at least from two directions on each of the facing side. Such arrangement allows easy regulation of the positioning.

On the other hand, as in the embodiment shown in FIG. 6, if the positioning is to be regulated at four locations (referred to by reference sign X) by stampers 42*a*, 42*a* of the shape as shown in FIG. 6 for stacking the blanks in piler 42, for example, without adjusting the orientations of the blanks B (as they are at the first inclination angle θ1), the blanks B being conveyed by the conveyor 40 may fall forward and be bogged down short of the pile, and thus may not be stacked in the right orientation. In addition, the piler 42 wastes space to deteriorate space efficiency at the production site.

Therefore, the adjustment of the orientation is important.

Second Embodiment

The unloader 30 having the orientation-adjuster is disposed in "installable area Z" of the mold 20.

It suffices that the unloader 30 having the orientation-adjuster is disposed in its major part with respect to the mold 20 or the "installable area Z" and, for example, as seen from above, the unloader 30 having the orientation-adjuster may extend out of the mold 20.

Here, an example of the "installable area Z" is discussed.

A first example of the installable area is an area, as shown in FIG. 2A, bounded by the edge 11*e* of a blank 11 (or B) on its unloading side at an inclination angle θ1 (see FIG. 2), the front end face 20*a* of the mold 20 on its unloading side, and side faces 20*b*, 20*c* of the mold 20.

Seen schematically, the edge 11*e* of a blank 11 (or B) on its unloading side corresponds to the line A-B, the front end face 20*a* of the mold 20 on its unloading side corresponds to the line C-D, and the side face 20*b* of the mold 20 corresponds to the line D-B while the side face 20*c* corresponds to the line A-C, so that the trapezoidal area bounded by the lines A-B-D-C is an installable area Z1.

A second example of the installable area is an area, as shown in FIG. 2B, bounded by the edge 11*e* of a blank 11 (or B) on its unloading side at an inclination angle θ1, which is smaller than that in FIG. 2A, the front end face 20*a* of the mold 20 on its unloading side, and the side face 20*b* of the mold 20.

Seen schematically, the edge 11*e* of a blank 11 (or B) on its unloading side corresponds to the line A-B, the front end face 20*a* of the mold 20 on its unloading side corresponds to the line A-D, and the side face 20*b* of the mold 20 corresponds to the line D-B, so that the triangle area bounded by the lines A-B-D is an installable area Z2.

As contrastively illustrated in the first and second examples, the installable area is formed corresponding to the shearing of blanks 11 (or B) at an inclination angle, and this area varies depending on the first inclination angle θ1 of blanks 11 (or B), the position of the blanks 11 (or B) with respect to the line direction CL, the profile of the edge 11*e* of the blanks 11 (or B) on its unloading side, or the like factors.

However, the installable area may be said to be basically a triangle area.

As discussed regarding the second embodiment, by disposing the unloader 20 having the orientation-adjuster in the installable area X, which was originally an idle space in the mold 20 other than the shearing section 12, an area having an inclination angle in the mold is effectively used, and both the adjustment of the orientations of the blanks and the unloading of the blanks in an orientation aligned to each other into the piler 41 are achieved at the same time. As a result, the blanks may be stably stacked in the piler 41.

Third Embodiment

The unloader 30 having the orientation-adjuster is equipped with, as shown in FIG. 7, three or more belt conveyors 31, 32, 33 arranged substantially in parallel in the order of the conveying distance for which the blanks are conveyed on the conveyors, wherein the conveying rate of a belt conveyor is faster with a longer conveying distance of the belt conveyor and slower with a shorter conveying distance, i.e., 31→32→33.

Further, the belt conveyors in the order of 31, 32, 33 may be arranged along the line direction CL as shown in the figure (the same may be applied also to other embodiments).

According to the third embodiment, the blanks, which are supported by three or more belt conveyors 31, 32, 33, undergo the orientation adjustment with little warping, so that the orientation adjustment may be stable.

Fourth Embodiment

As shown in FIG. 8, the unloader 30 having the orientation-adjuster may have a first belt conveyor 31 with a longer conveying distance and a second belt conveyor 32 with a shorter conveying distance, which are arranged substantially in parallel and on which the blanks are conveyed, and the first belt conveyor 31 may have at least two split conveyors 31A, 31B divided in the conveying direction, and the split conveyors 31A and 31B may be different in conveying rate.

According to this fourth embodiment, through setting or changing the speeds of the split conveyor 31A, the split conveyor 31B, and the second belt conveyor 32, the adjustment of the orientation may be controlled precisely.

Fifth Embodiment

The height of the belt conveyors 31, 32 may be different. For example, as shown in FIG. 9, the first belt conveyor 31 may be positioned at a higher level than that of the second belt conveyor 32.

In such a configuration, during swiveling of blanks for adjusting their orientation, more weight is applied to the second belt conveyor 32 with a shorter conveying distance while less weight is applied to the first belt conveyor 31 with a longer conveying distance, so that adjustment of the orientation involving swiveling or correction of warping of the blanks may be performed easily.

The latter, correction of warping of the blanks is discussed in detail. Blanks may be warped in one direction depending on the layout of the punching blades. In this case, by positioning the belt conveyor located under the side of the blank which would be warped and sagged as it stands, for example, the first belt conveyor 31, at a higher level than the level of the second belt conveyor 32, the blanks may quickly be mounted on a conveyor (the first belt conveyor 31 in this embodiment), which allows correction of the warping.

Sixth Embodiment

As shown in FIG. 10, the unloader 30 having the orientation-adjuster may have a first belt conveyor 31 with a longer conveying distance and a second belt conveyor 32 with a shorter conveying distance, which are arranged substantially in parallel and on which the blanks are conveyed, each blank B with respect to its longitudinal direction has a first portion B1 having a larger area of contact with a conveyor and a second portion B2 having a smaller area of contact with a conveyor, and the first portion B1 is associated with the second belt conveyor 32, whereas the second portion B2 is associated with the first belt conveyor 31.

Even the speed of the second belt conveyor 32 is increased, stable conveyance is performed, as the area of contact between the first portion B1 and the second belt conveyor 32 is larger. Further, as the conveying distance of the first belt conveyor 31 is longer, even the centrifugal force generated by the swiveling acts on the blanks, displacement or slipping of the blanks may be regulated to allow stable adjustment of the orientation.

Seventh Embodiment

As shown in FIG. 11, the unloader 30 having the orientation-adjuster may have a first belt conveyor 31 with a longer conveying distance and a second belt conveyor 32 with a shorter conveying distance, which are arranged substantially in parallel and on which the blanks are conveyed, each blank B with respect to its longitudinal direction has a first portion B1 having a larger area of contact with a conveyor and a second portion B2 having a smaller area of contact with a conveyor, and the first portion B1 is associated with the first belt conveyor 31, whereas the second portion B2 is associated with the second belt conveyor 32.

As the first portion B1 having a larger area of contact, which is also heavier, is carried on the first belt conveyor 31 with a longer conveying distance, even the centrifugal force generated by the swiveling acts on the blanks, displacement thereof may be regulated due to the friction force to allow stable adjustment of the orientation.

Here, selection between the sixth and seventh embodiments may be made depending on the shape of the blanks or the like.

Note that the blanks may have a laterally symmetric shape.

Eighth Embodiment

The above-discussed first to eighth embodiments may suitably be incorporated into the blanking and stacking apparatus according to the present invention.

Referring to FIGS. 1 to 3 illustrating a typical embodiment, there is provided a blanking apparatus 1 having a mold and configured to perform blanking of a continuous metal coil 10 fed from an uncoiler (not shown), and to unload and convey the resulting blanks 11 (B) from the mold 20.

The mold 20 has a shearing section 12, wherein blanking to produce blanks 11 is performed at an inclination angle θ1 with respect to the line direction CL in which the blanks 11 (B) are to be unloaded. The shearing section 12 includes, for example, a lower blade (blanking die) 12A of the lower mold and an upper blade (blanking punch) 12B of the upper mold, as shown in FIG. 3.

The mold 20 has, downstream of the shearing section 12, unloader 30 having an orientation-adjuster for adjusting the orientation of blanks 11 from an inclined state upon completion of the shearing at a first inclination angle θ1 with respect to the line direction CL to a larger, second inclination angle θ2, preferably perpendicular to the line direction CL.

Further provided on the exit side of the unloader is a conveyor 40 for blanks 11(B), and a piler 41 for stacking in succession the blanks 11 (B) conveyed out of the conveyor 40 into a pile.

As shown in FIGS. 2 and 3, the entry side of the blank-conveyor 40 is positioned below and underlapping the exit side of the unloader 30, so that the blanks 11 whose orientations have been adjusted may be allowed to fall onto the conveyor 40 for high-speed unloading and conveying.

Ninth Embodiment

According to the present invention, there is provided a blanking method, for example, as follows.

That is, the blanking method includes performing blanking of a feed of continuous metal coil 10 in a blanking apparatus 1 having a mold 20, and unloading and conveying the resulting blanks 11 (B) from the mold 20, and the mold 20 of the blanking apparatus 1 includes, downstream of the shearing section 12, unloader 30 having an orientation-adjuster for adjusting the orientation of blanks 11 from an inclined state upon completion of shearing at a first inclination angle θ1 with respect to the line direction CL to a larger, second inclination angle θ2, preferably perpendicular to the line direction CL.

The unloader 30 having the orientation-adjuster is disposed in the "installable area Z" of the mold 20 as discussed above.

According to this embodiment, with respect to the predetermined width of metal coil 10, the inclination angle is selected for the blanking process, in proportion to the length of the product to be produced by the blanking.

In this case, as shown in FIG. 12, the length and the inclination angle of the blanks B may be selected depending on the variation of width of the metal coil 10 for making the most of the area of the metal coil 10.

On the other hand, as shown in FIG. 13, when the predetermined width of the metal coil 10 is limited, the inclination angle of the blanks B may be selected for making the most of the area of the metal coil 10.

In this way, by means of an existing apparatus, longer blanks B than those which have been produced in the apparatus, or longer blanks B than the constant width of the metal coil being fed, may be produced, which enhances flexibility in designing and production.

DESCRIPTION OF REFERENCE NUMERALS

1: blanking apparatus
10: metal coil
11: blank
11*al*-11*a*3: punched area
11*b*1-11*b*3: contour-machined area
12: shearing section
12A: lower blade (blanking die)
12B: upper blade (blanking punch)
20: mold
30: unloader having orientation-adjuster
40: conveyor
41: piler
θ1: first inclination angle
θ2: second inclination angle
CL: line direction
Z, Z1, Z2: installable area

The invention claimed is:

1. A blanking apparatus configured to perform blanking of a feed of metal coil continuous in a line direction, and to unload and convey resulting blanks, comprising:

a mold comprising a shearing section for performing blanking of the feed of metal coil to produce blanks at an inclination angle with respect to the line direction in which the blanks are to be unloaded, and an unloader located downstream of the shearing section and having an orientation-adjuster for adjusting an orientation of the blanks from an inclined state at a first inclination angle with respect to the line direction to a larger, second inclination angle, wherein the unloader having the orientation-adjuster comprises a first belt conveyor with a longer conveying distance and a second belt conveyor with a shorter conveying distance, which are arranged substantially in parallel and on which the blanks are conveyed, with a conveying rate of the first belt conveyor being faster than a conveying rate of the second belt conveyor.

2. The blanking apparatus according to claim 1, wherein the unloader having the orientation-adjuster is disposed in its major part in an installable area bounded by an edge of a blank on its unloading side at the first inclination angle, a front end face of the mold on its unloading side, and side faces of the mold.

3. The blanking apparatus according to claim 2, wherein the first belt conveyor is arranged closer to a longer of the side faces defining the installable area, and the second belt conveyor is arranged closer to a shorter of the side faces defining the installable area.

4. The blanking apparatus according to claim 1, wherein the conveying rate of the second belt conveyor in the line direction is same as or higher than a feeding rate of the metal coil in the line direction.

5. The blanking apparatus according to claim 1, wherein the orientation-adjuster comprises three or more belt conveyors arranged substantially in parallel in an order of conveying distance for which the blanks are conveyed, and wherein a conveying rate of a belt conveyor is faster in an order of shorter to longer conveying distance of the belt conveyor.

6. The blanking apparatus according to claim 1, wherein the orientation-adjuster comprises the first belt conveyor with the longer conveying distance and the second belt conveyor with the shorter conveying distance, which are arranged substantially in parallel and on which the blanks are conveyed, and wherein the first belt conveyor comprises at least two split conveyors divided in a conveying direction, and the split conveyors are different in conveying rate.

7. The blanking apparatus according to claim 1, wherein one of the first belt conveyor and the second belt conveyor is positioned at a higher level than a level of the other.

8. The blanking apparatus according to claim 1, wherein the orientation-adjuster comprises the first belt conveyor with the longer conveying distance and the second belt conveyor with the shorter conveying distance, which are arranged substantially in parallel and on which the blanks are conveyed, wherein each blank with respect to its longitudinal direction has a first portion having a larger area of contact with a conveyor and a second portion having a smaller area of contact with a conveyor, and wherein the first portion is associated with the second belt conveyor, whereas the second portion is associated with the first belt conveyor.

9. The blanking apparatus according to claim 1, wherein the orientation-adjuster comprises the first belt conveyor with the longer conveying distance and the second belt conveyor with the shorter conveying distance, which are arranged substantially in parallel and on which the blanks are conveyed, wherein each blank with respect to its longitudinal direction has a first portion having a larger area of contact with a conveyor and a second portion having a smaller area of contact with a conveyor, and wherein the first portion is associated with the first belt conveyor whereas the second portion is associated with the second belt conveyor.

10. A blanking and stacking apparatus comprising:

a blanking apparatus comprising a mold and configured to perform blanking of a feed of continuous metal coil, and to unload and convey resulting blanks from the mold, wherein the mold comprises a shearing section for performing blanking of the feed of metal coil to produce blanks at an inclination angle with respect to a line direction in which the blanks are to be unloaded, and an unloader located downstream of the shearing section and having an orientation-adjuster for adjusting an orientation of the blanks from an inclined state at a first inclination angle with respect to the line direction to a larger, second inclination angle, an conveyor for the blanks located on an exit side of the unloader, and a piler for stacking in succession the blanks conveyed out of the conveyor into a pile, wherein the orientation-adjuster comprises a first belt conveyor with a longer conveying distance and a second belt conveyor with a shorter conveying distance, which are arranged substantially in parallel and on which the blanks are conveyed, with a conveying rate of the first belt conveyor being faster than a conveying rate of the second belt conveyor.

11. The blanking and stacking apparatus according to claim 10, wherein the unloader having the orientation-adjuster is disposed in its major part in an installable area bounded by an edge of a blank on its unloading side at the first inclination angle, a front end face of the mold on its unloading side, and side faces of the mold.

12. A blanking method comprising:

performing blanking of a feed of continuous metal coil in a blanking apparatus, and unloading and conveying resulting blanks, wherein the blanking apparatus comprises a mold, and the mold comprises:

a shearing section for performing blanking of the feed of metal coil to produce blanks at an inclination angle with respect to a line direction in which the blanks are to be unloaded, and an orientation-adjuster located downstream of shearing section in the line direction, for adjusting an orientation of the blanks on a conveying surface from an inclined state at a first inclination angle with respect to the line direction to a larger, second inclination angle, and for guiding the blanks forward from the mold, wherein the orientation-adjuster comprises a first belt conveyor with a longer conveying distance and a second belt conveyor with a shorter conveying distance, which are arranged substantially in parallel and on which the blanks are conveyed, with a conveying rate of the first belt conveyor being faster than a conveying rate of the second belt conveyor, and wherein the blanking is performed at an inclination angle selected from larger to smaller angles in proportion to a larger to smaller width of the metal coil to produce a predetermined length of the blanks.

13. A blanking method comprising:

performing blanking of a feed of continuous metal coil in a blanking apparatus, and unloading and conveying resulting blanks, wherein the blanking apparatus comprises a mold, and the mold comprises:

a shearing section for performing blanking of the feed of metal coil to produce blanks at an inclination angle with respect to a line direction in which the blanks are to be unloaded, and an orientation-adjuster located downstream of the shearing section in the line direction for adjusting an orientation of the blanks on a conveying surface from an inclined state at a first inclination angle with respect to the line direction to a larger, second inclination angle, and for guiding the blanks forward from the mold, wherein the orientation-adjuster comprises a first belt conveyor with a longer conveying distance and a second belt conveyor with a shorter conveying distance, which are arranged substantially in parallel and on which the blanks are conveyed, with a conveying rate of the first belt conveyor being faster than a conveying rate of the second belt conveyor, and wherein the blanking is performed at an inclination angle selected from smaller to larger angles in proportion to a larger to smaller length of the blanks, with respect to a predetermined width of the metal coil.

* * * * *